United States Patent [19]

Rosada

[11] Patent Number: 4,674,232

[45] Date of Patent: Jun. 23, 1987

[54] TROLLEY FOR SLIDING SASHES IN WINDOWS AND DOOR-WINDOWS

[76] Inventor: Antonio Rosada, via Nazionale n. 53, San Fior, Italy

[21] Appl. No.: 819,904

[22] Filed: Jan. 16, 1986

[30] Foreign Application Priority Data

Dec. 20, 1985 [IT] Italy ..... 63408/85[U]

[51] Int. Cl.[4] ..... E05D 13/02

[52] U.S. Cl. ..... 49/425; 16/99; 16/105

[58] Field of Search ..... 49/425; 16/105, 99, 16/100

[56] References Cited

U.S. PATENT DOCUMENTS

| | | | |
|---|---|---|---|
| 183,857 | 10/1876 | Laauwe | 49/425 X |
| 627,991 | 7/1899 | Ensign | 16/105 |
| 3,111,209 | 11/1963 | Riegelman | 49/425 |
| 3,281,993 | 11/1966 | Riegelman | 49/425 |
| 3,370,383 | 2/1968 | Riegelman | 49/425 |
| 3,670,357 | 6/1972 | Steigerwald | 49/425 X |
| 4,262,451 | 4/1981 | Dallaire | 49/425 |

FOREIGN PATENT DOCUMENTS

| | | | |
|---|---|---|---|
| 408697 | 2/1966 | Switzerland | 49/425 |

*Primary Examiner*—Philip C. Kannan
*Attorney, Agent, or Firm*—Darby & Darby

[57] ABSTRACT

The invention falls within the technical field of windows closed by sliding sashes, that for the purpose are provided with grooved wheels adapted to run along rails integral with a lower crosspiece of the fixed frame forming, together with the sashes, said window.

The wheel is mounted on a pivot which is supported by means connected to a box-shaped element and designed for enabling a vertical displacement of said post. Provision is also made for means adapted to readily adjust the position of the pivot relative to the box-shaped element which is disposed within the post of the sliding sash.

2 Claims, 6 Drawing Figures

TROLLEY FOR SLIDING SASHES IN WINDOWS AND DOOR-WINDOWS

FIELD AND BACKGROUND OF THE INVENTION

The present invention relates to a trolley for sliding sashes in windows and door-windows.

Current sliding sashes in windows and door-windows are provided with wheels mounted in a fixed position in the lower crosspiece of the sashes.

On the contrary, the upper crosspieces of the sashes are provided with a groove into which a guide bar integral to the upper crosspiece of the fixed window frame is inserted.

The assembling of the sashes takes place during the step of installation of the windows, so that once a window has been positioned, it is no longer possible to disassemble the sash, unless the whole fixed window frame is disassembled.

This is an important drawback when it is necessary to replace the pane of glass of a sash.

A further drawback pertaining to the sashes of known type consists in that it is not possible to execute any adjustment of the position of the wheel relative to the sash in order to eliminate possible plays between the sash and the fixed frame and to eliminate possible differences in the squaring between the sash and the fixed frame.

In the case of aluminum fixed frames a wedge-shaped device has been provided which acts on the wheels to adjust the squaring of the sash relative to the fixed frame, but said device only allows very little shiftings ranging from one to two millimeters and therefore it cannot be used for assembling and disassembling sashes from window frames.

OBJECT

The object of the present invention is to obviate the above mentioned drawbacks and in particular to allow the sashes to be readily applied to the fixed frames as well as to be disassembled therefrom without being obliged to disassemble the fixed frames too.

The technical problem that the trolley of the present invention is adapted to solve is to allow the wheels of the frames to carry out a rather wide vertical displacement, ranging for example between 10 and 20 mm, in order to enable the engagement of the upper crosspieces of a sash with the corresponding guide bar and the disengagement therefrom.

SUMMARY OF THE INVENTION

The foregoing and still further objects are achieved by the trolley of the present invention comprising:

a box-shaped element open at the bottom and provided with a front plate adapted to fasten said element to a post of a sliding sash;

a wheel inserted inside said box-shaped element and susceptible of carrying out a vertical displacement;

a horizontal pivot on which said wheel is loosely mounted;

transport means for said pivot connected to the box-shaped element and adapted to allow said pivot to move substantially in a vertical direction;

adjustment means adapted to adjust the position of said pivot relative to the box-shaped element.

The advantage offered by the trolley of the present invention consists in that it is possible first to completely assemble the fixed window frame and afterwards insert the sliding sashes into the fixed frame, being possible to adjust the position of the sashes relative to said fixed frame in the best manner.

A further advantage consists in that the trolley in question can only be inserted at the lower end of the sash post so that it also serves to lock said post to the lower crosspiece of the sash.

A still further advantage which however can be achieved in combination with a contrivance applied to the rail, is due to the fact that it is possible to reach a temporary-locking position of the sash to the frame.

BRIEF DESCRIPTION OF THE DRAWINGS

Further features and advantages will become more apparent from the following description of a preferred embodiment given by way of non-limiting example, in the accompanying drawings, in which.

DESCRIPTION OF THE PREFERRED EMBODIMENT

Figure 2:
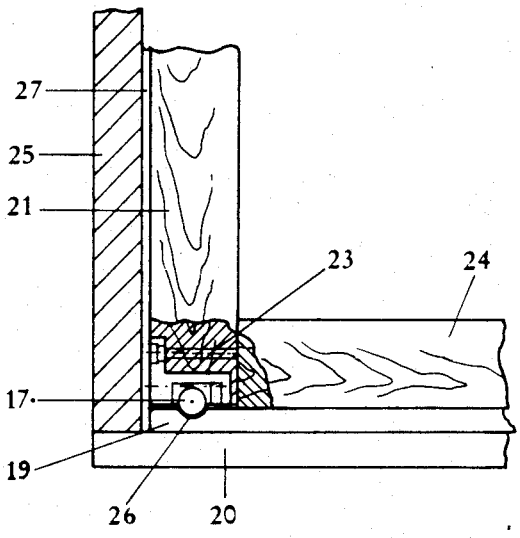
FIG. 2 is a front view of the trolley inserted into the lower end of a sash post.

Referring to FIGS. 3, 4, 5 and 6, the trolley, globally identified at 1, comprises a box-shaped element 2 of substantially parallelepiped form and open at the bottom. The box-shaped element 2 consists in fact of two side walls 3 and 4, a front plate 5 and a back plate 6. Two holes are obtained in the front plate: an upper hole 7 and a central hole 8 into which is introduced the head of a screw 9 passing through the front plate 5 and the back plate 6.

The screw 9 has a threaded portion **9*a* which is screwed down in a prismatic block 10 and a cylindrical threadless portion 9*b* that passes through the back wall 6 and is locked by means of a spring-lock ring 11** in order to avoid unthreading.

Therefore the screw 9 acts as a worm screw because, by its rotation, it causes the displacement of the prismatic block 10 to which, through a pivot 12 introduced into the block itself, two rods 13 are hinged.

Two further rods 14 are hinged, through a pivot 15, to the front plate 5 and both pairs of rods 13 and 14 support a pivot 16 on which a grooved wheel 17 is idlely mounted.

The two pairs of rods 13 and 14 act as support means for the pivot 16 and allow a substantially vertical displacement of the latter whereas the screw 9 and the prismatic block 10 constitute the adjustment means for the vertical position of the pivot 16 relative to the box-shaped element 2.

The displacement of the prismatic block 10 therefore causes the raising or lowering of the wheel 17 relative to the box-shaped element 2.

Figure 1:
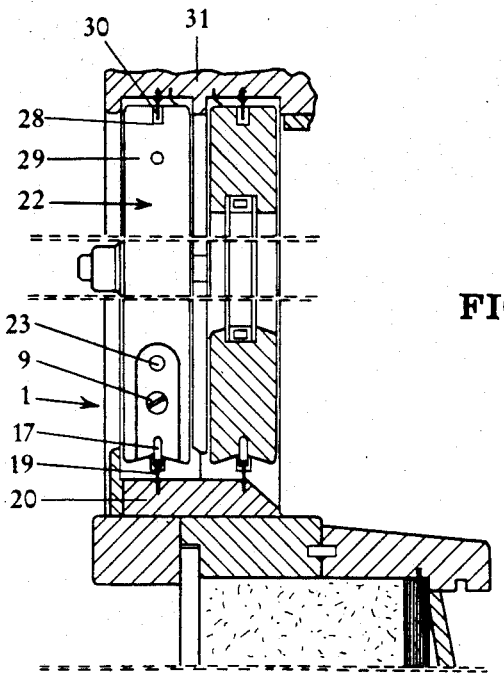
FIG. 1 is a side view of the trolley inserted into a sliding window sash.
Figure 3:
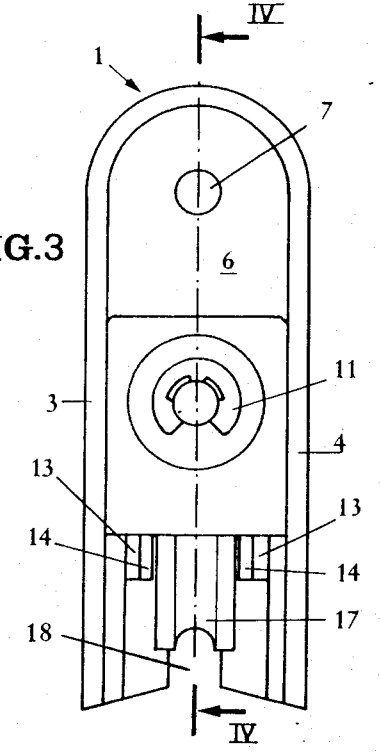
FIG. 3 is a side view of the trolley, opposed to the view shown in FIG. 1.
Figure 4:
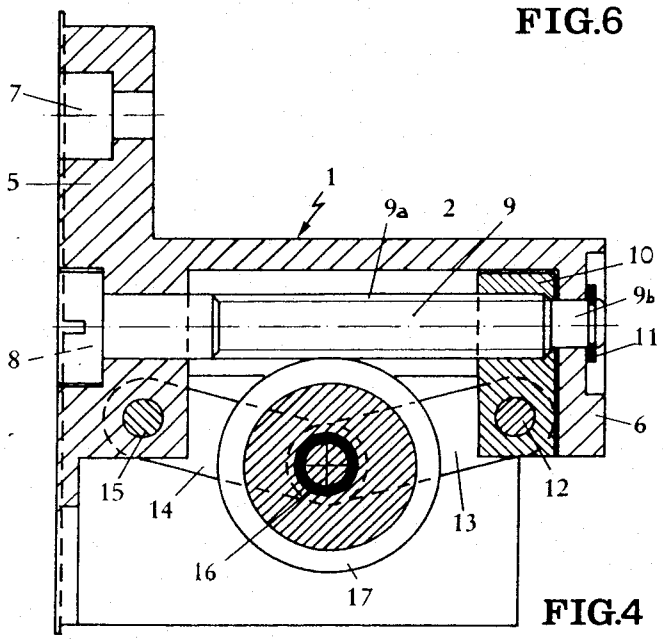
FIG. 4 is a front view of the trolley taken along the line IV—IV in FIG. 3.
Figure 6:
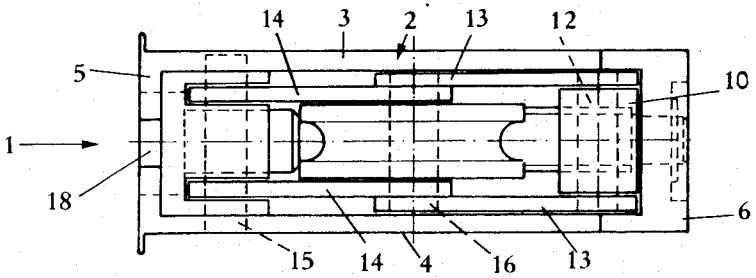
FIG. 6 is a bottom plan view of the trolley.
Figure 5:
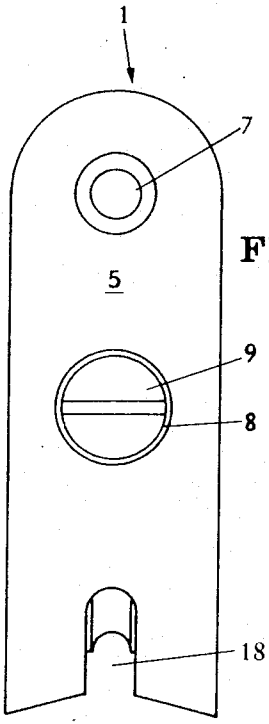
FIG. 5 shows the trolley according to a side view similar to that seen in FIG. 1 and opposed to that shown in FIG. 3.

The front plate 5 is provided at its lower part with a slit 18 aligned with the wheel 17 and through which a rail 19 mounted on the lower crosspiece 20 of a fixed window frame can pass, as clearly shown in FIGS. 1 and 2.

Referring to FIGS. 1 and 2, the trolley is inserted into the post 21 of a sash 22 and fastened to the same by a screw 23 fitted into the hole 7 of the front plate 5. The screw 23 also performs the function of joining together the post 21 and the lower crosspiece 24 of the sash 22.

The rail 19 is provided, close to the jamb 25 of the fixed window frame, with a recess 26 which is a few millimeters deep. By virtue of said recess 26 the sash 22 can be slightly inclined towards the jamb 25 of the fixed frame when the wheel 17 enters the recess, in order to allow a stable adhering of the sash against a seal 27 disposed between the post 21 of the sash 22 and the jamb 25 of the fixed frame.

The assembling of the sash 22 can take place when the fixed frame has already been assembled because it is sufficient to bring the wheel 17 to its raised position then make the sash 22 (which is provided with a guide groove 28 obtained in the upper crosspiece 29) slide in the guide bar 30 integral to the upper crosspiece 31 of the fixed window frame.

Acting upon the screw 9, the wheel 17 is caused to move downwardly so that its groove can be fitted onto the rail 19.

It is clear that for disassembling the sash 22 it is sufficient to act in the opposite manner and it is not necessary to disassemble the fixed window frame.

Obviously, modifications and variations may be made to the present embodiment without departing from the scope of the invention as defined in the appended claims. For example, the adjustment of the position of the pivot 16 in the wheel 17 could be obtained by other means provided that it is adapted to ensure a relatively wide vertical displacement of the wheel 17 so that the groove 28 of the upper crosspiece 29 of the sash 22 may be fitted on the guide bar 30 and be disengaged therefrom.

What is claimed is:

1. A trolley for use with a sliding sash in windows and door-windows, the sash including at least one post, the trolley comprising:

a box-shaped element having an open bottom, and a front plate adapted to fasten the element to the at least one sash post;

a wheel at least partially housed by the box-shaped element and situated at the open bottom thereof;

a pivot, the wheel being rotatable mounted on the pivot;

means for supporting the pivot and wheel, the supporting means being mounted on the box-shaped element and being adapted to allow the pivot and wheel to be displaced inwardly and outwardly with respect to the box-shaped element; and means for adjusting the inward and outward displacement of the pivot and wheel with respect to the box-shaped element, the adjusting means including a prismatic block, the prismatic block being mounted on the box-shaped element and moveable with respect thereto and in a direction transverse to the direction of inward and outward displacement of the pivot and wheel;

the supporting means including first and second pairs of rods, each rod of the first and second pairs having opposite first and second ends, the first ends of the first pair of rods being pivotally mounted to the box-shaped element, and the first ends of the second pair of rods being pivotally mounted to the moveable prismatic block, the second ends of the first and second pairs of rods being mounted on the pivot, the second ends of the first pair of rods being pivotal with respect to the second ends of the second pair of rods, wherein movement of the prismatic block effects the inward and outward displacement of the pivot and wheel with respect to the box-shaped element.

2. A trolley as defined by claim 1, wherein the adjusting means further includes a worm screw rotatably mounted on the box-shaped element, the prismatic block engaging the worm screw whereupon rotation of the worm screw effects the movement of the prismatic block.

* * * * *